United States Patent [19]

Conley et al.

[11] Patent Number: 4,641,673

[45] Date of Patent: Feb. 10, 1987

[54] CLEANING DEVICE FOR PAINT ROLLERS AND BRUSHES

[76] Inventors: John M. Conley, 911 Crescent Dr., Monrovia, Calif. 91016; Paul D. Bowen, P.O. Box 5201, Bend, Oreg. 97708

[21] Appl. No.: 692,372

[22] Filed: Jan. 16, 1985

Related U.S. Application Data

[63] Continuation-in-part of Ser. No. 519,050, Aug. 1, 1983, abandoned.

[51] Int. Cl.[4] ..... B08B 3/02

[52] U.S. Cl. ..... 134/138; 134/149; 15/38; 68/213

[58] Field of Search ..... 134/115, 51, 138, 139, 134/149; 248/110, 113; 211/66; 15/38; 68/213

[56] References Cited

U.S. PATENT DOCUMENTS

| | | | |
|---|---|---|---|
| 1,040,021 | 10/1912 | Sanborn et al. | 134/138 X |
| 2,239,741 | 4/1941 | Schroder | 15/38 X |
| 2,449,818 | 9/1948 | Olsen | 134/149 X |
| 2,498,511 | 2/1950 | Smith | 248/113 X |
| 2,794,265 | 6/1957 | Kruger | 15/38 X |
| 2,826,826 | 3/1958 | Boehm | 34/58 |
| 2,902,773 | 9/1959 | Dudek | 15/38 X |
| 2,938,368 | 5/1960 | Bixel | 134/138 X |
| 2,965,111 | 12/1960 | Feigelman | 134/135 |
| 3,085,583 | 4/1963 | Siek | 134/135 X |
| 3,116,745 | 1/1964 | Burning | 248/110 X |
| 3,688,785 | 9/1972 | Stevens et al. | 134/138 |
| 3,696,457 | 10/1972 | Hand | 134/149 X |
| 3,886,960 | 6/1975 | Krueger | 134/138 |
| 4,018,240 | 4/1977 | Palthe | 15/38 X |
| 4,130,124 | 12/1978 | Sherwin | 134/138 |
| 4,294,272 | 10/1981 | Klaiber | 134/138 |

FOREIGN PATENT DOCUMENTS 2360884 6/1975 Fed. Rep. of Germany ..... 134/138

*Primary Examiner*—Harvey C. Hornsby
*Assistant Examiner*—Frankie L. Stinson
*Attorney, Agent, or Firm*—Boniard I. Brown

[57] ABSTRACT

Both paint rollers and paint brushes may be cleaned of water base paints within this apparatus which comprises an open ended tubular housing which contains a water manifold which produces a series of water jets which are aligned with the elongated axis of the housing and which impact either the paint roller or the paintbrush in a slightly offset fashion so as to impart a spin thereto. An adjustable clamping means is located on the outside of the housing on the side opposite the location of the water manifold which adapts to a variety of different configurations of paint roller holder rods in order that the paint roller itself may be properly disposed within the interior of the housing such that the axis of the roller aligns with the axis of the housing. The water jets then impact off-center on the pile of the paint roller, washing out the paint, and imparting a spin to the roller which throws off the diluted paint and the wash water. Paint brushes are cleaned in the apparatus by employing an additional element, a brush holder, which fits into one of the open ends of the housing. The brush holder acts to align the brush along the axis of the housing and in the path of the water jets. Additionally, the paintbrush cleaning apparatus desirably includes a second series of water jets which emanate from a second water manifold which connects to the distal end of the water manifold discussed above, such that the second series of water jets is directed upwardly parallel to the bristles of the paintbrush to deeply cleanse therewithin.

7 Claims, 15 Drawing Figures

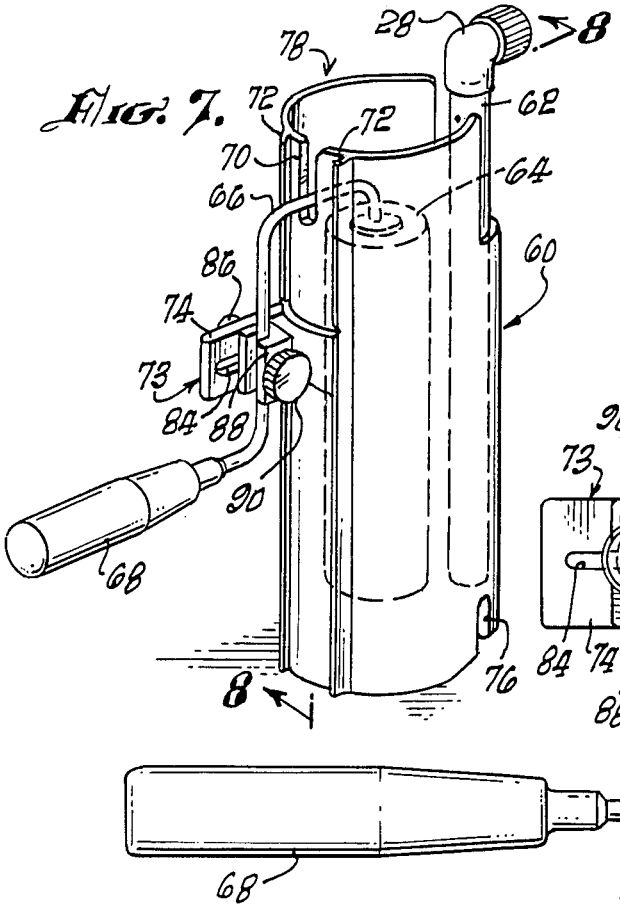
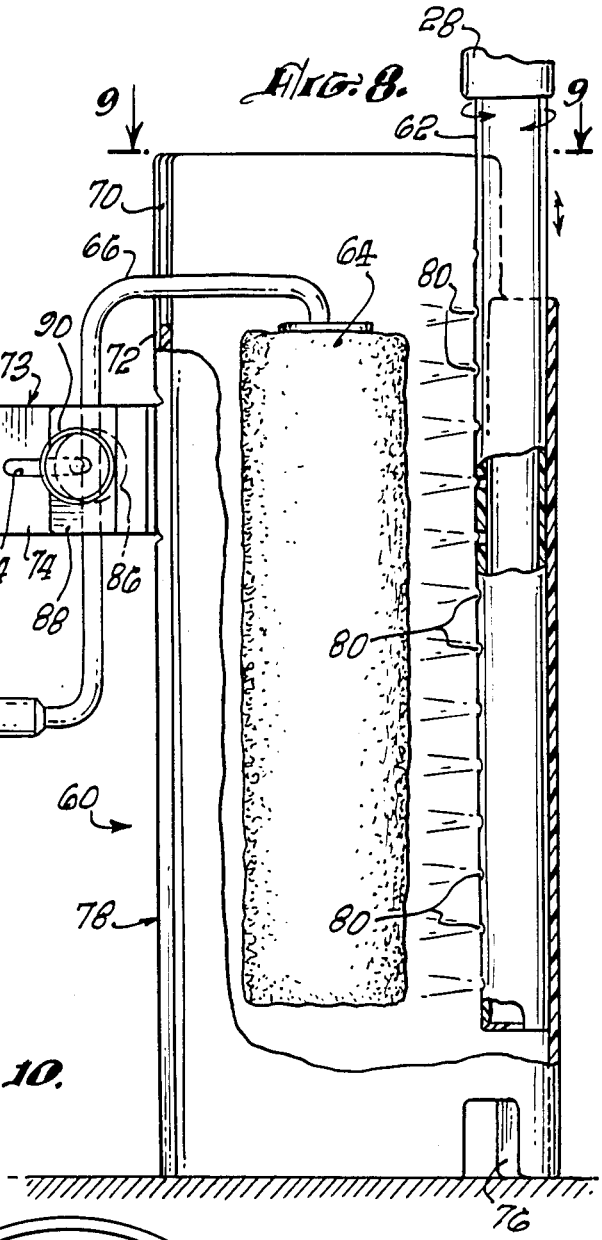
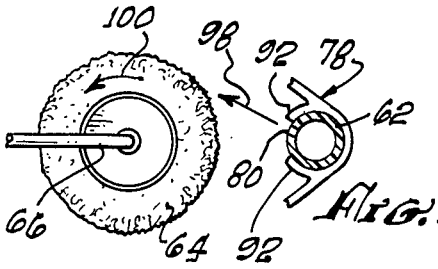
FIG. 10.
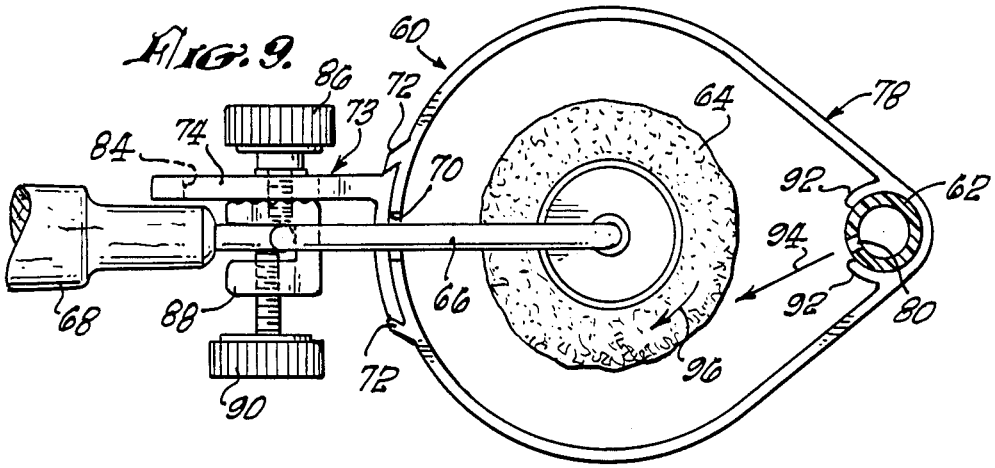

126
122
124
136
128
134
73
112
12
118
114
142
130
132
110
78
138
13
119
120
76
116
123
144
146
92
140

CLEANING DEVICE FOR PAINT ROLLERS AND BRUSHES

This is a Continuation-In-Part of Application Ser. No. 519,050, filed Aug. 1, 1983 and now abandoned.

BACKGROUND OF THE INVENTION

This invention relates to apparatus useful in cleaning wet paint from paint rollers and brushes. More particularly, this invention relates to apparatus used in water cleansing of paint rollers and brushes utilizing water based paints.

Paint rollers are exceedingly useful and efficient tools for applying paint to large surface areas. Unfortunately, it is rather difficult to clean the paint from the roller after the roller has been used. At present there are a number of ways to clean a paint soaked roller, although neither is particularly efficient. One method is to place the paint roller assembly, consisting of the paint soaked roller and its holder, in water and repeatedly squeeze the roller by hand to mechanically remove most of the paint from the roller. A final rinse under running water is performed in an effort to remove the remaining paint residue. Another method is to remove the paint soaked roller from its roller and install this roller on a hand held mechanical device. The roller is then submerged under water, and the mechanical device is pumped continually by hand to impart a slow rotary motion to the roller. The rotary motion and turbulence of the water removes most of the paint. Again, a final rinse under running water is performed in an effort to remove the remaining paint residue. Both methods are time consuming and require the continual presence and physical effort of the person performing the cleaning operation. Also, both methods require direct handling of the roller which is saturated with wet paint, resulting in a very messy task. Finally, with either method, unless the cleaning process is continued for an inordinate length of time, there will almost always be a residue of paint left within the roller. Although this will not represent a problem if the same shade of paint is used again with the same roller, this residual paint of one hue will often prevent the use of the semi-cleaned roller with paints of different hues. For these reasons, it is often the case that a paint roller will be thrown away after use rather than cleaned, a wasteful practice which continues for the want of an effective paint roller cleaning apparatus.

A paint roller cleaning device marketed under the name "Spin Out" has been manufactured in Seattle and sold in at least the Pacific Northwest within the last year. It is marked "patent pending." This is a simple device about the size and shape of a shoe box and formed of plastic. This prior art roller cleaner has provision for attachment to a hose bib and an internal water manifold along the inside of the top of the device and parallel to the roller from which issue a series of water jets which soak and presumably spin clean the paint roller. The bottom of the device is completely open and is opposite the water jets. One end of the device has a cut out area into which the paint roller handle is received such that the roller may be held by hand within the enclosed area encompassed by the device. Nevertheless, there is no provision for clamping the paint roller handle to the device, nor is there any provision for any convenient means of employment of the device other than in conjunction with a threaded hose bib over a sink. The large bottom opening of the device will create a relatively messy procedure as well.

German Pat. No. 2,716,931 to F. Aierstoch discloses a centrifugal cleaning device for paint rollers having internal water jets which cause spin on the paint roller.

Cleansing of water based paints from paintbrushes presents similar problems. Cleaning such brushes by hand is a time consuming and messy operation. No mechanized apparatus to achieve the cleansing of the brushes is known.

It is therefore an object of this invention to provide for an apparatus which effectively cleans paintbrushes.

It is a further object of this invention to provide for a paint roller cleaning apparatus which can be utilized semi-automatically.

It is yet another object of this invention to provide for a paint roller cleaning apparatus which is of simple construction and relatively inexpensive such that the widespread discarding of used paint rollers for lack of an effective and inexpensive roller cleaner may be largely eliminated.

It is a further object of this invention to provide for an apparatus which effectively cleans paintbrushes.

It is another object of this invention to provide for a paintbrush cleaning apparatus which can be used semi-automatically.

SUMMARY OF THE INVENTION

This apparatus is capable of cleaning water soluble paint from both paint rollers and paintbrushes. It comprises a water conducting manifold means having a first elongate longitudinal axis disposed parallel to the interior axis of a tubular housing means containing the water conducting manifold means. This first manifold has a first plurality of orifices which produce a series of water jets disposed generally in a plane which is parallel to but does not intersect the interior center line of the housing. The apparatus is also provided with water supply means to pass water to the water manifold. The housing means is tubular in configuration and at least partially encloses the manifold means and the paint roller or paintbrush. The manifold means is held onto the interior of the housing by protruding extrusions which serve to clamp the manifold to the housing means. The exterior of the housing includes manually operable and adjustable clamping means to secure the holder rod of the paint roller such that the rotating axis of the roller is disposed in an effective position relative to the water jets such that spin may be produced by the action of the water jets upon the roller should a paint roller be cleaned by the apparatus. This clamping means is located on the side of the housing opposite that which has the water manifold. Finally, should a paintbrush be desired to be cleaned within the apparatus, there is provided a removable brush means fitting into one end of the housing means for retaining the brush within the interior of the housing such that the long axis of the brush is generally parallel to the elongate interior axis of the housing.

The apparatus may also be provided with a second water manifold means which is connected to the distal end of the first water manifold means relative to the water supply means. This second manifold extends at right angles to the first and produces a second series of water jets which spray upwardly into the interior of the housing in a direction generally parallel to the bristles of a paintbrush held therewithin by the removable brush holder which fits into the opposite ends of the housing means. This second water manifold means may also be employed when cleaning paint rollers; however, it is best to include a removable top to enclose the upper end of the housing such that escape of water from the second series of water jets is substantially prevented. The removable brush holder can take at least two forms. The first is a hollow fluted arrangement which extends downwardly from the top end of the housing. The handle of the paintbrush is confined within the hollow interior of this fluted element by a setscrew. The bristles of the brush extend downwardly into the remainder of the housing under the influence of the water jets. The action of the first series of water jets upon the fluted element acts to impart a spin to this rotating brush holder, thereby adding to the cleaning action of the apparatus. The rotating action of the brush holder is effectively stabilized by a perforated circular skirt at the bottom end of the fluted element which prevents extreme nutation of the brush holder upon rotation. In another embodiment, the fluted element is dispensed with and a slit diaphram means is included in a central region of the capping element of the brush holder. This capping element is the upper portion of the brush holder element which nests into the open upper end of the housing. The paintbrush handle would be inserted from below up through the slit in the diaphram in the brush holder, and then the brush holder would be installed into the top of the housing with the brush bristles then being disposed within the housing to be acted upon by the water jets. The handle of the brush would then extend upwardly from the top of the brush holder and be manually controlled by an operator.

BRIEF DESCRIPTION OF THE DRAWINGS

FIG. 7 is an isometric view of the second embodiment of the paint roller cleaner;

FIG. 8 is a sectional view taken along vertical section lines 8—8 in FIG. 7 showing the configuration of the interior of the paint roller cleaning apparatus;

FIG. 9 is a top view of the embodiment shown in FIG. 7 showing further details of the clamping means as well as the rotatable nature of the water manifold within the housing showing the array of water jets in a first direction;

FIG. 10 is a detailed view corresponding to the matching parts in FIG. 9 in which the orientation of the water jets from the water manifold has been changed by an operator by rotation of the water manifold such that a reverse rotation is imparted to the paint roller;

DETAILED DESCRIPTION OF THE INVENTION

Figure 1:
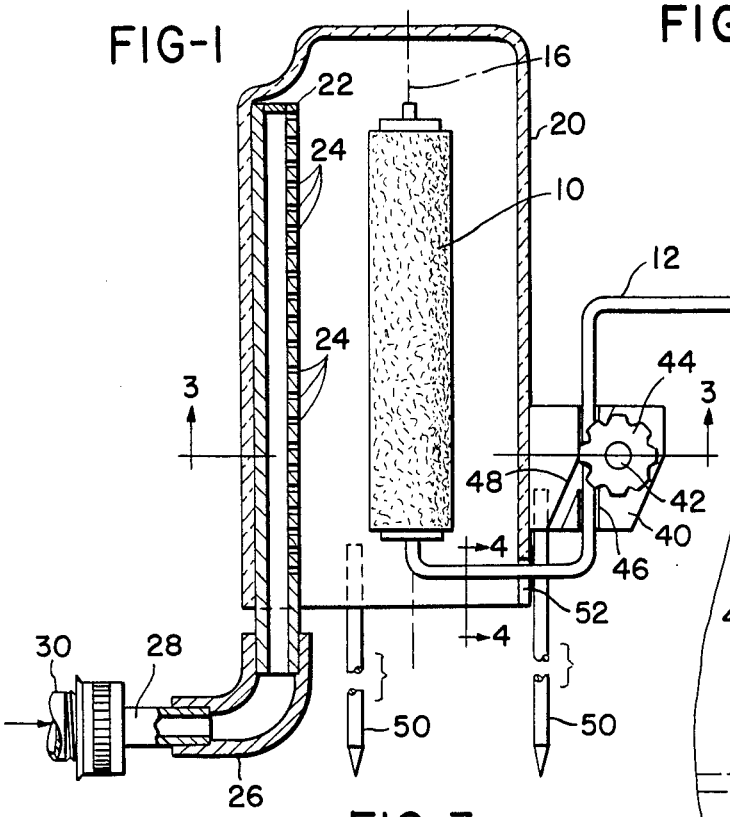
FIG. 1 is a sectional view taken along the longitudinal axis of one embodiment of the cleaning apparatus of this invention.

The various apparatus of this invention are very effective in cleaning paint from paint rollers and brushes. The water jets forcefully impinge upon the roller or brush which is clamped into the apparatus. The jets hit the roller in a fashion to impart a vigorous spin to the roller. The water hitting the roller also loosens and removes the paint in addition to producing the rapid rotation. In the embodiment for cleaning brushes, the water jets again forcefully impinge upon the bristles of the brush and also upon the brush holder acting to impart spin onto the brush holder with the brush clamped therein. Additional water jets impinge upon the brush from below directly into the bristles. The combination of these various water jets as well as the rotational motion, acts to effectively clean the brush.

Before turning to the specific embodiments of this invention illustrated in the drawing figures, it should be realized that there are a variety of different embodiments which may be created to exploit this invention. For example, the specific invention described below envisions a roughly cylindrical or tubular housing to enclose the paint roller and the water manifold means. However, the housing enclosure need not take this exact shape and is only needed to confine the paint and water which are flung from the rotating roller in order that a general mess is not created. Additionally, the water manifold in the specific embodiment is shown as a separate structure from the enclosing structure. With modern plastic forming techniques, it is easy to form a combined housing and manifold structure in which the two are but integral parts of the whole. Also, the water manifold assembly is shown as a single series of linearly arrayed jets. It is not necessary that these jets be in a single linear array as shown, since the important effect is that the sum effect of the multiple jets is to impart the spin to the roller. By the same token, it would be possible to employ multiple arrays of jets within the housing enclosure, so long as the rotating effect is retained.

Turning now to the drawings, FIG. 1 is a sectional view taken along the longitudinal axis of one embodiment of this invention. The paint roller 10 is attached to its holder 12 which includes a handle 14. The roller has an axis of rotation defined by the center line 16. The roller is enclosed within the housing enclosure 20 shown here in sectional outline. The housing enclosure 20 also encloses the water manifold 22 shown in section with a plurality of orifices 24 from which the water jets originate. The water supply means which convey water to the water manifold are shown here as an elbow 26 in section and a female hose connector 28 with an attached cut away garden hose 30. The paint roller holder 12 is firmly gripped by a manually operated clamping means here shown as a flange 40 attached to the outside of the housing enclosure 20 which includes a threaded bolt 42 which receives a standard hand nut 44 which clamps down upon the paint roller holder 12. The flange is provided with two grooves 46 and 48 which serve to confine the holder 12. The presence of the two grooves is necessitated by the fact that there are two types of paint rollers in common use. The one illustrated here has bends at generally right angles. There is another type of paint roller holder which has a bend in the vicinity of the flange which is not at a right angle to the axis of the handle 14. Also shown in this view are legs 50. These are provided with sharp points such that the apparatus may be stuck into the ground when the apparatus is used outside. The water exits the various jet orifices 24 and hits the paint soaked roller 10 imparting the spinning motion which loosens the paint from the nap of the roller 10, puts it into solution with the water, and then runs out the open bottom of the enclosure 20 onto the ground in this embodiment. In another embodiment the legs could be attached to a stable platform for use in a sink or other drainable receptacle such that the paint-water effluent may be carried away. Also, the legs may be omitted altogether in other usages.

Figure 2:
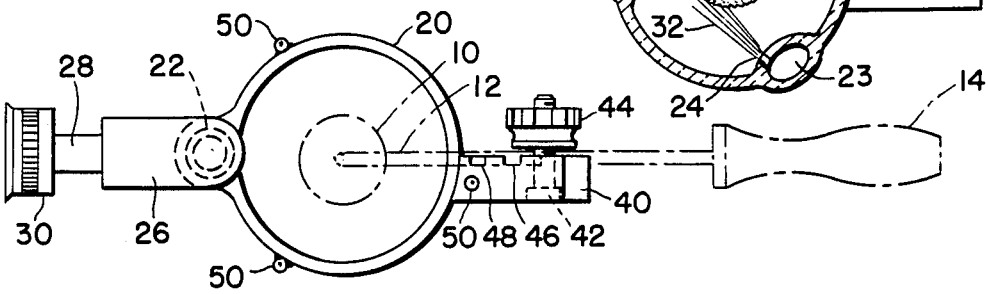
FIG. 2 is an end view of the apparatus of this invention viewed from the bottom of the device.

FIG. 2 is an end view of the apparatus of this invention viewed from the bottom of the device. Shown here is the bottom edge of the housing enclosure 20, the legs 50, the water supply elbow 26 with its attached female receptacle 28 for a garden hose, the flange 40 with its paint roller holder 12 grooves 46 and 48, the threaded bolt 42, and the hand nut 44.

Figure 3:
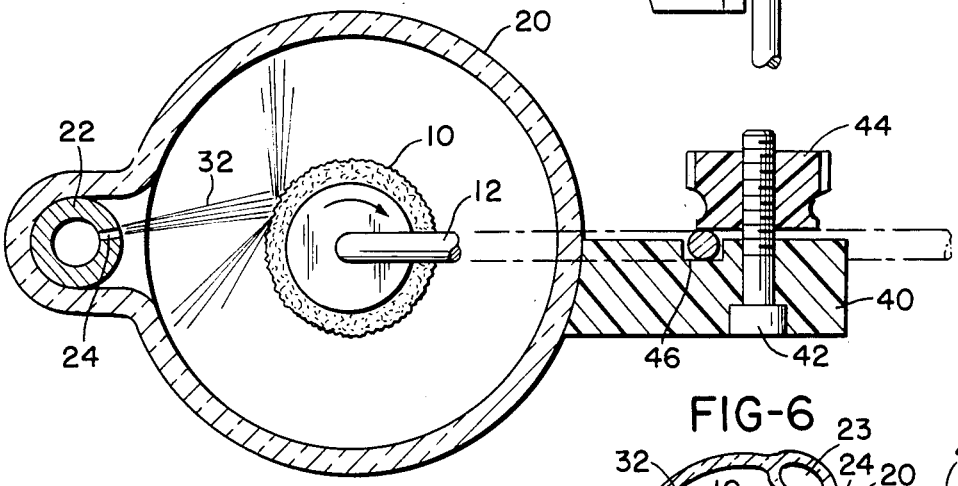
FIG. 3 is a transverse sectional view taken along the section lines shown in FIG. 1.

FIG. 3 is a sectional view taken along the section lines 3—3 indicated in FIG. 1. This figure directly illustrates the action of the water jets 32 which originate from the orifices 24 and the water manifold 22. The impingement of the water jets 32 upon the paint roller 10 causes rotation of the paint roller as indicated. Also shown in this view is the sectional representation of the housing 20, the flange 40, the paint roller holder 12 with its retaining groove 46, the threaded bolt 42 and the hand nut 44.

Figure 4:
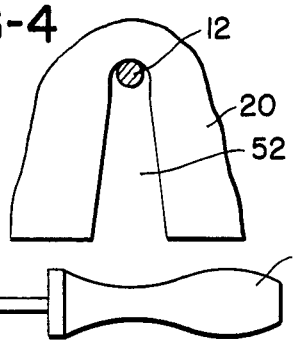
FIG. 4 is a cut-away sectional view taken along the section lines shown in FIG. 1.

FIG. 4 is a detail cut away side view showing a portion of the housing enclosure 20 which is cut away in a region 52 to receive the paint roller holder rod 12 in such a fashion that in combination with the action of the manually operated clamping means, the paint roller is rigidly confined within the housing enclosure. This clamping system lends greatly increased utility to this paint roller when compared to the prior art "Spin Out" roller since it eliminates the need to hand hold the roller within the apparatus. Since the cleaning process usually takes at least three minutes, a user will clearly prefer the present invention over the prior art because the user need not attend to the present device at all once it is set up and washing the clamped-down roller. The only actions required by the user are to put the roller in the device, turn on the water, wait, turn off the water, and then remove the cleaned roller. The cleansing is automatic once the water is turned on.

Figure 5:
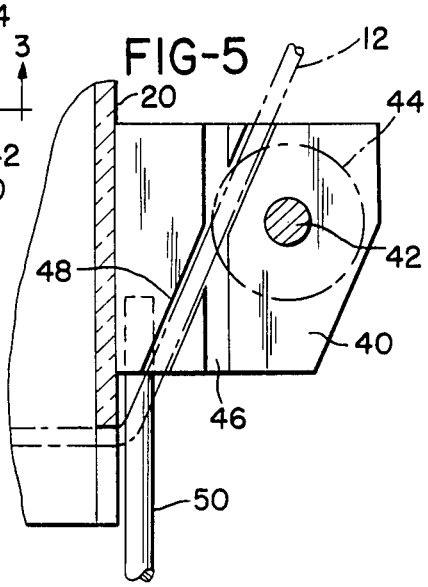
FIG. 5 is an enlarged portion of the clamping means shown in FIG. 1.

FIG. 5 is a detail of the manually operable clamping means illustrated in FIG. 1. Shown again is the flange 40, the first and second grooves 46 and 48 within the flange which serve to retain the two different configurations o the paint roller holder rod 12 (here shown with a slant type paint roller holder rod rather than the right angle paint roller holder rod as shown in FIG. 1), a leg 50, and a sectional representation of the housing enclosure 20.

Figure 6:
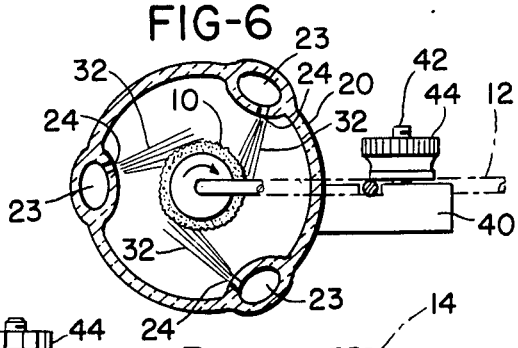
FIG. 6 is a transverse sectional view of a second embodiment of the invention.

FIG. 6 is a cross sectional view of a second embodiment of the invention taken along a plane similar to the section plane used for FIG. 3. In this embodiment the water manifold means has multiple water chambers 23, each of which has its own array of water orifices 24 producing the water jets 32 as shown. The water chambers 234 are integrally molded as part of the housing enclosure 20, forming an integral structure therewith. The spinning roller 10 and its holder 12 are retained by the hand nut 42 on the bracket 40 as in the first embodiment. Now shown are the common water passages of the water manifold which connect the water chambers 23 to the water supply means.

FIGS. 7 through 15 illustrate embodiments which are in many senses interchangeable in that by substitution of various elements the basic housing may be interchangeably used as either a paint roller cleaner or a paintbrush cleaner. The embodiments illustrated in FIGS. 7 through 10 show the basic housing utilized as a paint roller cleaner. The remaining figures utilize additional elements with the basic housing to effectively clean paintbrushes. Returning to FIG. 7 in particular, this figure shows a paint roller cleaning apparatus 60 which has a female garden hose connector 28 connected to the water manifold 62 which is received within the interior of the housing 78. Also shown are the paint roller with its roller axis 64 aligned parallel with the elongate axis of the housing 78 and the water manifold 62. The paint roller also includes the roller holder rod 66 which is effectively contained by the slot 70 at the upper end of the housing and the adjustable clamp 73. The handle 68 of the paint roller is also shown. The clamp 73 slides within a dove-tail groove 72 in the exterior of the housing 78. Also shown is a further slot 76 at the bottom of the housing 78 which provides for the removal of fluids from the interior of the housing.

FIG. 8 shows a cut-away vertical section of the apparatus shown in FIG. 7 showing again the water manifold 62 with the paint roller 64 which rotates within the housing 78. Also shown are the paint holder rod 66 and the paint roller handle 68. The holder rod 66 is shown secured by the adjustable clamp, here shown with its flange 74 which contains a slot 84 which provides for adjustment of the further elements of the clamping means which are shown in the succeeding figures.

FIG. 9 is a top view of the apparatus shown in FIG. 7. Shown again are the housing 78, the paint roller 64, the holder rod 66 and the roller handle 68. Also shown are the dove-tail extrusions 72 formed in the exterior of the holder 78 which confine the flange 74 of the adjustable clamp. Other features of the adjustable clamp shown in this view are a first thumbscrew 86 which rides within the slot 84 shown in FIG. 8. This thumbscrew 86 connects to a U-shaped channel 88 which has a second thumbscrew 80 which in turn clamps onto the holder rod 66. Although this adjustable clamp is here shown being used with a particular holder rod configuration in which the portion which is clamped is essentially parallel to the rotating axis of the paint roller, the adjustable clamping means can be easily moved to accommodate holder rods which are bent at this clamping region at an angle of, for example, 45° or so relative to the rotates axis of the paint roller. This type of configuration of the holder rod is shown in FIG. 5, although illustrated in conjunction with a non-adjustable clamp in that figure. In any event, the adjustable nature of this clamp allows the apparatus to be employed with a variety of different configurations of holder rods. In all such applications, the holder rod will be effectively secured by the adjustable clamp means in combination with passing the holder rod 66 through the slot 70 shown in FIG. 7 to effectively position the paint roller within the housing such that the rotating axis of the paint roller 64 is essentially parallel with the elongate axis of the water manifold 62. Also shown in this view are the retaining ridges 92 also formed in the housing 78 on the interior thereof which act to confine the water manifold within the housing. These retaining bridges 92 are formed at a tolerance relative to the exterior of the water manifold 62 which allows for an operator to adjustably rotate the water manifold 62 about its elongate axis. In this manner, the angle of the water jets exiting the water manifold 62 through the holes may be adjusted relative to the paint roller such that optimum cleaning of the roller may be effectuated. This feature is illustrated in FIG. 9 by the angle of the water jets shown by the arrow 94 which causes the rotation in the direction shown by the arrow 96 onto the roller 64. This should be contrasted with the reverse direction of spin imparted in FIG. 10 by an appropriate adjustment of the direction of the jets in the water manifold 62 exiting through the holes 80 at a different angle shown by the arrow 98. This imparts a reverse spin as shown by the arrow 100 on the roller 64. Also, the changing of the angle of the water jets in this fashion can act to clean more deeply into the nap of the roller by causing the water jets to impinge in a more perpendicular fashion into the surface of the paint roller 64 or to impart a greater rate of spin by impacting in a more tangential fashion. This adjustable feature of the invention represents an important advance in terms of optimizing the effectiveness of the cleansing.

Figures 11, 12, 13, 14, 15:
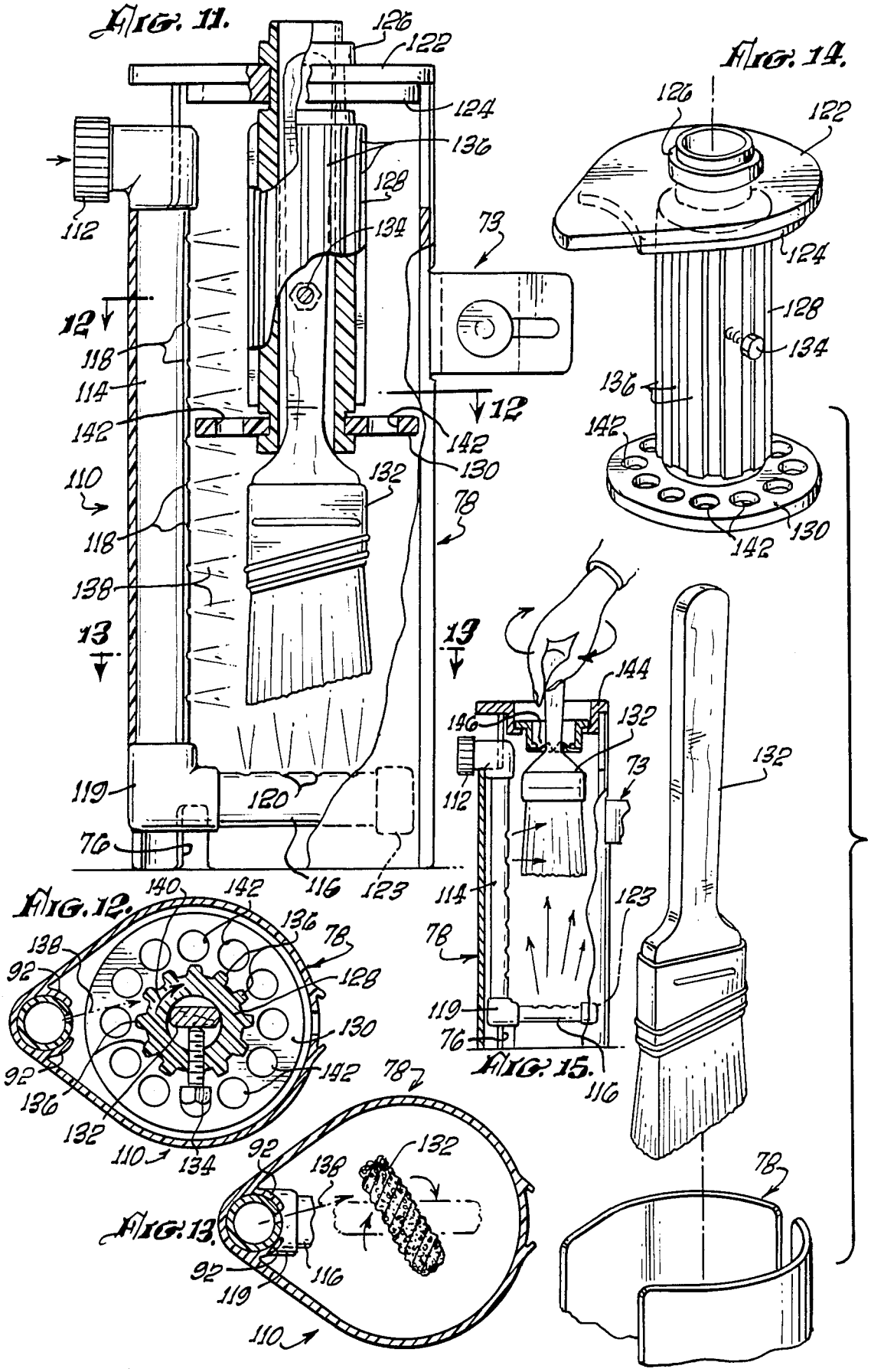
FIG. 11 is a cut-away side view of one embodiment of the paintbrush cleaning apparatus of this invention.
FIG. 12 is a sectional view looking down into the apparatus from above, taken along section lines 12—12 shown in FIG. 11.
FIG. 13 is another transverse sectional view looking down into the apparatus shown in FIG. 11, taken along section lines 13—13 of FIG. 11, showing the impingement of the water jets as in FIG. 12 imparting a rotation onto the paintbrush.
FIG. 14 is an exploded isometric view of the brush holder element and the housing element of the brush cleaning apparatus showing the relative positions of these elements in relation to the paintbrush.
FIG. 15 is a vertical sectional view comparable to that shown in FIG. 11, showing manipulation of the paintbrush in the housing by an operator.

FIGS. 11 through 15 show additional embodiments of the invention which are directed towards the cleaning of brushes while used with the housing illustrated in the preceding FIGS. 7 through 10. The important differences here are that a slightly different water manifold is utilized and a brush holder element is also used. Turning to FIG. 11 in particular, this figure shows a cutaway side view of the embodiment showing a female hose connector 112 which is connected to the top of the first section 114 of the water manifold. This first section is the longer section of the water manifold which is parallel to the long axis of the holder assembly 78. At the bottom of the first element 114 of the water manifold there is a 90° elbow 119 which serves to connect the second portion 116 of the water manifold which extends horizontally in this view with holes 120 therein directed upwardly to impact directly into the bristles of the brush 132. The second element 116 of the water manifold is terminated by a cap 123. Also shown are the holes 118 in the first element 114 of the water manifold. The water jets emanating from these holes 118 are generally parallel to the long axis of the brush 132. This embodiment is referred to generally as 110 in this figure. The brush holder shown here comprises a first cap element which here comprises two parts 122 and 124. The first part 122 fits above the upper rim of the housing 78. Attached thereto is a second portion 124 which is configured to nest within the upper rim of the housing 78 such that the cap assembly itself once placed into the top of the housing 78 will be securely retained therewithin. Extending through this cap element is the brush holder itself which includes a fluted hollow element 128 and an upper extension thereof 126 which passes through the cap element and rotates therein. The upper portion 126 has a projecting lip which prevents the fluted element 128 which hangs below from dropping down into the housing. This fluted element further includes a thumbscrew means 134 which clamps onto the brush 132, the handle of which extends upwardly into the hollow interior of the fluted element where it is retained by the setscrew 134. An additional element of the brush holder is a skirt element 130 which extends radially outward from the bottom portion of the fluted element 128. This skirt acts to retain the axial rotation of the fluted element 128 generally parallel to the elongate axis of the housing 78 by preventing nutations of the fluted element which might otherwise occur under the influence of the water jets. The circular skirted element 130 has an outside diameter which fits loosely within the interior diameter of the housing 78 such that rotation of the brush holder is easily maintained.

FIG. 12 is a top view shown in section taken along the lines 12—12 shown in FIG. 11. This view shows a sectional view of the fluted element 128 shown in the various flutes 136 which are acted upon by the water jets 138 coming from the first element of the water manifold 114 which impinge upon the flutes 136 acting to cause a rotation of a brush holder in the direction shown by the arrow 140. Also shown in this view are the housing 78 with its retaining projections 92 which serve to retain the water manifold 114 in the interior of the housing. Also shown is the skirt element 130 shown with its loose rotating fit at its outside dimension within the housing element 78. The skirt element is perforated by a plurality of holes 142 to allow for the draining of the water from the upper portion of the housing 78 and out through the drain slot 76 shown in FIG. 11. Shown also in this view are the thumbscrew 134 acting upon the handle of the paintbrush 132 to secure the paintbrush within the brush holder.

FIG. 13 is another view comparable to that in FIG. 12 shown in rotating action of the paintbrush in a lower portion of the apparatus. The rotation of the paintbrush 132 in the direction shown by the arrow 140 under the action of the water jets 138 coming from the water manifold 114 is illustrated herein. Shown also in this view are the dove-tail extrusions 72 which were illustrated in more detail the the preceding figures. These dove-tail extrusions in the exterior of the housing 78 act to retain the same adjustable clamp 73 illustrated in FIG. 11 and also in the preceding FIGS. 7, 8 and 9. Although the adjustable clamp is not utilized when a brush is cleaned within the housing 78, it is anticipated that the clamp would be left on the housing rather than slid out of the dove-tail since the apparatus would normally be used in an interchangeable fashion as between the paint roller and the paintbrushes.

FIG. 14 is an exploded view of the apparatus shown in cross sectional view of FIG. 11, showing the details of the paintbrush holder. Once again, the cap which is retained within the upper lip of the holder comprises again the upper element 122 and a lower element 124 which act to nest securely within the upper lip of the housing 78 as shown in FIG. 11. The fluted element 128 is hollow and receives the handle of the paintbrush 132 and secures it therein by means of the thumbscrew 134. The fluted element rotates within the flange element and is prevented from falling down into the interior of the housing 78 by the protruding lip on the upper portion of the brush holder 126. Also shown in this view are the skirt element 130 with its holes 142. Also shown in this view is the upper portion of the housing 78 with the roller holder rod receiving slot 70 which is useful when the holder is utilized for the paint roller cleaning implementation.

FIG. 15 illustrates a separate embodiment for cleaning paintbrushes. In this embodiment the fluted brush holder is omitted in favor of a manually operated brush holder which comprises a first nesting element 144 which is molded to be retained within the upper lip of the housing 78 in much the same fashion as the cap element illustrated in FIGS. 11 and 14 which there comprise the upper and lower elements 122 and 124. Contained within this nesting element 144 for the embodiment illustrated in FIG. 15 is a central region which contains a diaphram element which is perforated such that the handle of the paintbrush 132 may be extended therethrough such that the water and paint thrown off from the brush cleaning action within the holder 78 do not splash upwardly through the diaphram element 146. Although the action of the water jets from the water manifold will act to impart some degree of rotary motion to the paintbrush 132, it will be rather minor in importance, and rotation of the paintbrush desirably should be imparted by an operator by hand as shown in this figure. Again, the distinction between the embodiments shown in FIG. 15 from that shown in FIGS. 11, 12, 13 and 14 is that the configuration of the brush holder is different. Although both brush holders act to securely retain the brush within the interior of the housing 78 under the influence of the water manifold with its impinging water jets, the embodiment in the FIGS. 11–14 operates semi-automatically while the embodiment in FIG. 15 requires manual actuation.

The paint roller cleaning embodiments illustrated in FIGS. 7–10 could also be provided with the second element 116 of the water manifold as shown in FIG. 11 to provide for total interchangeability between cleaning brushes and rollers. However, the second series of water jets will act to spray out of the open upper end of the housing to the extent that certain of these jets do not impact the paint roller. To this end, a removable cap is provided which is similar in configuration to the two elements 122 and 124 of the cap shown in FIGS. 11 and 14 except that this new cap has no hole in its center as does the cap shown in FIGS. 11 and 14.

It will be apparent to those skilled in the art that modifications and variations can be made in the preferred embodiment disclosed herein without departing from the scope or the spirit of the invention. Thus it is intended that the present invention include these modifications and variations which come within the scope of the appended claims and their equivalents.

What is claimed is:

1. An apparatus for cleaning water soluble paint from a paint roller or a paint brush comprising:

first water conducting manifold means having a first elongate longitudinal axis disposed parallel to the elongate interior axis of a tubular housing means containing the water conducting manifold means, the manifold means having a plurality of orifices producing a series of water jets disposed generally in a plane which is parallel to the elongate interior axis of the housing means;

water supply means in fluid communication with the manifold means;

the tubular housing means at least partially enclosing the manifold means and the paint roller or paint brush, the manifold means being held onto the interior of the housing means by extrusions which serve to clamp the manifold to the housing means, wherein the exterior of the housing means includes manually operable and adjustable clamping means to secure a holder rod of the paint roller such that the rotating axis of the roller is disposed in an effective position relative to the water jets such that spin may be produced by the action of the water jets upon the roller should a paint roller be cleaned by the apparatus;

removable brush holder means adapted to fit into one end of the housing means for retaining the brush within the interior of the housing means under the influence of the cleaning action of the water jets, should a brush be chosen to be cleaned within the apparatus;

said brush holder comprising a first cap element removably received within the upper end of the housing and an externally fluted cylindrical element having a hollow interior with an open lower end rotatably mounted in and extending below the cap into the housing means, the fluted element including clamping means to securely retain the handle of the brush within the hollow interior of the fluted element such that the series of water jets from the first water conducting manifold means will impact the flutes in a tangential manner and impart a spin to the fluted element and the clamped brush; and a second water conducting manifold means in fluid communication with the distal end of the first water conducting manifold means and connected thereto at a right angle having a second series of water jets emanating therefrom and directed generally upwardly parallel to the bristles of the paint brush and impacting therein.

2. The apparatus of claim 1 wherein the fluted element further includes a perforated lower circular skirt element extending radially outwards from the lower end of the fluted element, which is received in a loose fit by the housing to prevent excessive nutation of the spin axis of the fluted element during rotation thereof.

3. The apparatus of claim 2 wherein the clamping means in the fluted element comprises a thumbscrew which urges the handle of the brush against the interior side of the fluted element opposite the thumbscrew.

4. An apparatus for cleaning water soluble paint from a paint roller or a paint brush comprising:

first water conducting manifold means having a first elongate longitudinal axis disposed parallel to the elongate interior axis of a tubular housing means containing the water conducting manifold means, the manifold means having a plurality of orifices producing a series of water jets disposed generally in a plane which is parallel to the elongate interior axis of the housing means;

water supply means in fluid communication with the manifold means;

the tubular housing means at least partially enclosing the manifold means and the paint roller or paint brush, the manifold means being held onto the interior of the housing means by extrusions which serve to clamp the manifold to the housing means, wherein the exterior of the housing means includes manually operable and adjustable clamping means to secure a holder rod of the paint roller such that the rotating axis of the roller is disposed in an effective position relative to the water jets such that spin may be produced by the action of the water jets upon the roller should a paint roller be cleaned by the apparatus;

removable brush holder means adapted to fit into one end of the housing means for retaining the brush within the interior of the housing means under the influence of the cleaning action of the water jets, should a brush be chosen to be cleaned within the apparatus;

said brush holder comprising a first cap element movably received within the upper end of the housing and a slit diaphragm means received concentrically within the cap element such that the handle of the brush may be inserted therethrough from below in order that the bristles of the brush may be acted upon by the water jets from the first water conducting manifold means and further comprising a second water conducting manifold means in fluid communication with the distal end of the first water conducting manifold means and connected thereto at a right angle having a second series of water jets emanating therefrom and directed generally upwardly parallel to the bristles of the paint brush and impacting therein.

5. An apparatus for cleaning water soluble paint from a paint roller rotatably attached to its holder rod comprising:

water conducting manifold means having an elongate longitudinal axis disposed parallel to the rotating axis of the paint roller, the manifold means being rotatable about its longitudinal axis and having a plurality of orifices producing a first series of water jets which impact the paint roller and impart a spin to the roller about its axis;

water supply means in fluid communication with the manifold means; and tubular housing means at least partially enclosing the manifold means and the roller, the manifold means being adjustably rotatable within a receiving recess along one portion of the interior of the housing, and including external adjustable clamping means to secure the paint roller holder rod such that the rotating axis of the roller is effectively disposed relative to the water jets in order that the the spin to the roller is produced and the housing effectively confines the water and paint spun off from the roller wherein the clamping means comprise a clamp assembly movable in a friction fit in an exterior dove-tail channel in the housing means aligned parallel to the receiving recess and generally diametrically opposite thereto, the clamp assembly comprising a base portion captured by the dove-tail channel in the housing with a planar flange extending generally perpendicular outward therefrom and oriented parallel to the dove-tail channel, the flange containing a slot in this perpendicular direction which captures a first thumbscrew which adjustably secures a U-shaped channel means to the flange, the channel means being adapted to receive the roller holder rod within its U-shaped recess and securely confine it therein by a second thumbscrew mounted in the channel means, the clamping means thereby being able to adjust to an effective range of angles that the paint roller holder rod may assume relative to the proper position of the rotating axis of the roller within the housing.

6. An apparatus for cleaning water soluble paint from a paintbrush having a handle disposed along a first axis comprising:

water conducting manifold means with a first portion having a first elongate longitudinal axis disposed parallel to the first axis of the paintbrush and a second portion having a second axis perpendicular to the axis of the first portion and disposed below the paintbrush, the first portion of the the manifold means having a first plurality of orifices producing a first series of water jets in a general plane which impacts the paintbrush at a position offset from the axis of the brush, thereby acting to impart a spin to the brush, and a second series of upwardly directed jets emanating from the second portion of the manifold means which is in fluid communication and attached to the distal end of the first portion of the manifold, the second series of upwardly directed jets being disposed generally parallel to the bristles of the brush and impacting therein;

water supply means in fluid communication with the manifold means; p1 housing means enclosing the brush and the manifold and having an open lower end and an open upper end adapted to receive a brush holder; and a brush holder removably received in the upper end of the housing means wherein the brush holder comprises a first cap element removably received within the upper end of the housing and an externally fluted element having a hollow interior with an open lower end rotatably mounted in and extending below the cap into the housing, the fluted element including clamping means to securely retain the handle of the brush within the hollow interior of the fluted element such that the first series of water jets will impact the flutes in a tangential manner and impart a spin to the fluted element and the retained brush.

7. The apparatus of claim 6 wherein the fluted element includes a perforated lower circular skirt element extending radially outwards from the lower end of the fluted element, which is received in a loose rotating fit by the housing to prevent excessive nutation of the spin axis of the fluted element during rotation.

* * * * *